US011085675B2

(12) United States Patent
Wu

(10) Patent No.: US 11,085,675 B2
(45) Date of Patent: Aug. 10, 2021

(54) HYBRID HEAT PUMP SYSTEM

(71) Applicant: City University of Hong Kong, Kowloon (HK)

(72) Inventor: Wei Wu, Kowloon (HK)

(73) Assignee: City University of Hong Kong, Kowloon (HK)

( * ) Notice: Subject to any disclaimer, the term of this patent is extended or adjusted under 35 U.S.C. 154(b) by 44 days.

(21) Appl. No.: 16/440,255

(22) Filed: Jun. 13, 2019

(65) Prior Publication Data

US 2020/0393172 A1 Dec. 17, 2020

(51) Int. Cl.
*F25B 25/02* (2006.01)

(52) U.S. Cl.
CPC ..... *F25B 25/02* (2013.01)

(58) Field of Classification Search
CPC ..... F25B 25/02; F25B 29/00; F25B 29/003; F25B 29/006; F25B 25/00
USPC ..... 62/332
See application file for complete search history.

(56) References Cited

U.S. PATENT DOCUMENTS 4,031,712 A * 6/1977 Costello ..... F25B 1/00 62/483
4,285,211 A * 8/1981 Clark ..... F25B 27/007 62/335
9,052,128 B2 * 6/2015 Grefe ..... H01M 8/04059
2007/0019708 A1 * 1/2007 Shiflett ..... C09K 5/047 374/181

* cited by examiner

*Primary Examiner* — Steve S Tanenbaum
(74) *Attorney, Agent, or Firm* — Renner Kenner Greive Bobak Taylor & Weber

(57) ABSTRACT

A system and a method for a hybrid heat pump system including first compression means operable to form a refrigerant in vapor form and increases the pressure of the refrigerant vapor; condensing means arranged to receive the pressurized vapor and condenses the vapor under pressure to a liquid; pressure reduction means through which the liquid refrigerant leaving the condensing means passes to reduce the pressure of the liquid to form a mixture of liquid and vapor refrigerant; evaporator means arranged to receive the mixture of liquid and vapor refrigerant that passes through the pressure reduction means to evaporate the remaining liquid to form first and second portions of refrigerant vapor; second compression means including two, first and second inlet ports and an outlet port and operable to: receive at least a portion of the refrigerant vapor from the evaporator means, the pressurized vapor from the first compression means, and the vapor refrigerant from the condensing means through the first and second inlet ports respectively; increase the pressure thereof; and pass the pressurized vapor to the condensing means through the outlet port; and a conduit operable to pass a portion of the refrigerant vapor leaving the first compression means to the second compression means.

56 Claims, 12 Drawing Sheets

HYBRID HEAT PUMP SYSTEM

FIELD OF INVENTION

The present invention relates to a hybrid heat pump system, and more particularly, to a hybrid absorption-compression heat pump system with one or more refrigerant injections for use in cooling and heating.

BACKGROUND

Heat pump technologies are attracting increasing interests in building energy efficiency owing to the high energy efficiencies for space cooling, space heating and water heating. Conventional heat pump cycles include electrically-driven vapor-compression cycle and thermally-driven absorption cycle. To combine the advantages of both cycles with an impact configuration, it's better to use the hybrid absorption-compression heat pump, in which the compression sub-cycle and the absorption sub-cycle share the condenser, expansion valve and evaporator.

SUMMARY OF INVENTION

In accordance with a first aspect of the present invention, there is provided a hybrid heat pump system comprising:

- first compression means operable to form a refrigerant in vapor form and increases the pressure of the refrigerant vapor;
- condensing means arranged to receive the pressurized vapor and condenses the vapor under pressure to a liquid;
- pressure reduction means through which the liquid refrigerant leaving the condensing means passes to reduce the pressure of the liquid to form a mixture of liquid and vapor refrigerant;
- evaporator means arranged to receive the mixture of liquid and vapor refrigerant that passes through the pressure reduction means to evaporate the remaining liquid to form first and second portions of refrigerant vapor;
- second compression means including two, first and second inlet ports and an outlet port and operable to:
  - receive at least a portion of the refrigerant vapor from the evaporator means, the pressurized vapor from the first compression means, and the vapor refrigerant from the condensing means through the first and second inlet ports respectively;
  - increase the pressure thereof; and
  - pass the pressurized vapor to the condensing means through the outlet port; and
  - a conduit operable to pass a portion of the refrigerant vapor leaving the first compression means to the second compression means.

In an embodiment of the first aspect, the second compression means further includes an injection-type compressor for injecting the combination of the pressurized vapor from the first compression means and the vapor refrigerant from the condensing means to the second compression means.

In an embodiment of the first aspect, the second compression means further includes a two-stage compressor, whereby a portion of the refrigerant vapor from the evaporator means is introduced to the first stage of the second compression means and the combination of the pressurized vapor from the first compression means and the vapor refrigerant from the condensing means is injected between the first stage and the second stage of the second compression means subsequent to the first stage.

In an embodiment of the first aspect, the second compression means further includes two, first and second serially-connected compressors, whereby a portion of the refrigerant vapor from the evaporator means is introduced to the first compressor of the second compression means and the combination of the pressurized vapor from the first compression means and the vapor refrigerant from the condensing means is injected between the first compressor and the second compressor.

In an embodiment of the first aspect, the second compression means further includes a dual-cylinder compressor for each receiving and compressing a portion of the refrigerant vapor from the evaporator means and the combination of the pressurized vapor from the first compression means and the vapor refrigerant from the condensing means individually and for passing both to the condensing means.

In an embodiment of the first aspect, the second compression means further includes two, first and second parallelly-connected compressors for each receiving and compressing a portion of the refrigerant vapor from the evaporator means and the combination of the pressurized vapor from the first compression means and the vapor refrigerant from the condensing means individually and for passing both to the condensing means.

In an embodiment of the first aspect, the first compression means further includes:

- an absorber that forms a mixture of a refrigerant and an absorbent; and
- a generator that receives the mixture from the absorber and heats the mixture to separate refrigerant, in vapor form, from the absorbent.

In an embodiment of the first aspect, the pressure of the refrigerant vapor from the generator is increased by the second compression means.

In an embodiment of the first aspect, the pressure at the outlet port is higher than that at the two inlet ports, and the pressure at the second inlet port is higher than that at the first inlet port.

In an embodiment of the first aspect, a portion of the vapor leaving the evaporator means and the combination of the pressurized vapor leaving the first compression means and the vapor refrigerant from the condensing means are received by the second compression means individually and pressurized by the second compression means and subsequently condensed by the condensing means.

In an embodiment of the first aspect, a portion of the vapor leaving the evaporator means and the vapor refrigerant from the condensing means are received and pressurized by the second compression means, and the pressurized vapor leaving the first and second compression means are subsequently condensed by the condensing means.

In an embodiment of the first aspect, a portion of the vapor leaving the evaporator means and the pressurized vapor leaving the first compression means are received and pressurized by the second compression means, and the pressurized vapor leaving the second compression means is subsequently condensed by the condensing means.

In an embodiment of the first aspect, a portion of the vapor leaving the evaporator means is received and pressurized by the second compression means, and the pressurized vapor leaving the first and second compression means are subsequently condensed by the condensing means.

In an embodiment of the first aspect, the first compression means is activated and the second compression means is deactivated, whereby the refrigerant vapor leaving the evaporator means is received by the first compression means and subsequently received and condensed by the condensing means.

In an embodiment of the first aspect, the first compression means is deactivated and the second compression means is activated, whereby the refrigerant vapor leaving the evaporator means and the vapor refrigerant from the condensing means are received and pressurized by the second compression means and subsequently received and condensed by the condensing means.

In an embodiment of the first aspect, the first compression means is deactivated and the second compression means is activated, whereby the refrigerant vapor leaving the evaporator means is received and pressurized by the second compression means and subsequently received and condensed by the condensing means.

In an embodiment of the first aspect, the fluid communication between the first compression means and the condensing means is manipulated by a first valve and the fluid communication between the first and second compression means is manipulated by a second valve.

In an embodiment of the first aspect, the second compression means includes at least one of reciprocating compressor, rolling compressor, scroll compressor, screw compressor, and centrifugal compressor.

BRIEF DESCRIPTION OF DRAWINGS

Embodiments of the present invention will now be described, by way of example, with reference to the accompanying drawings in which.

DETAILED DESCRIPTION

Figure 1:
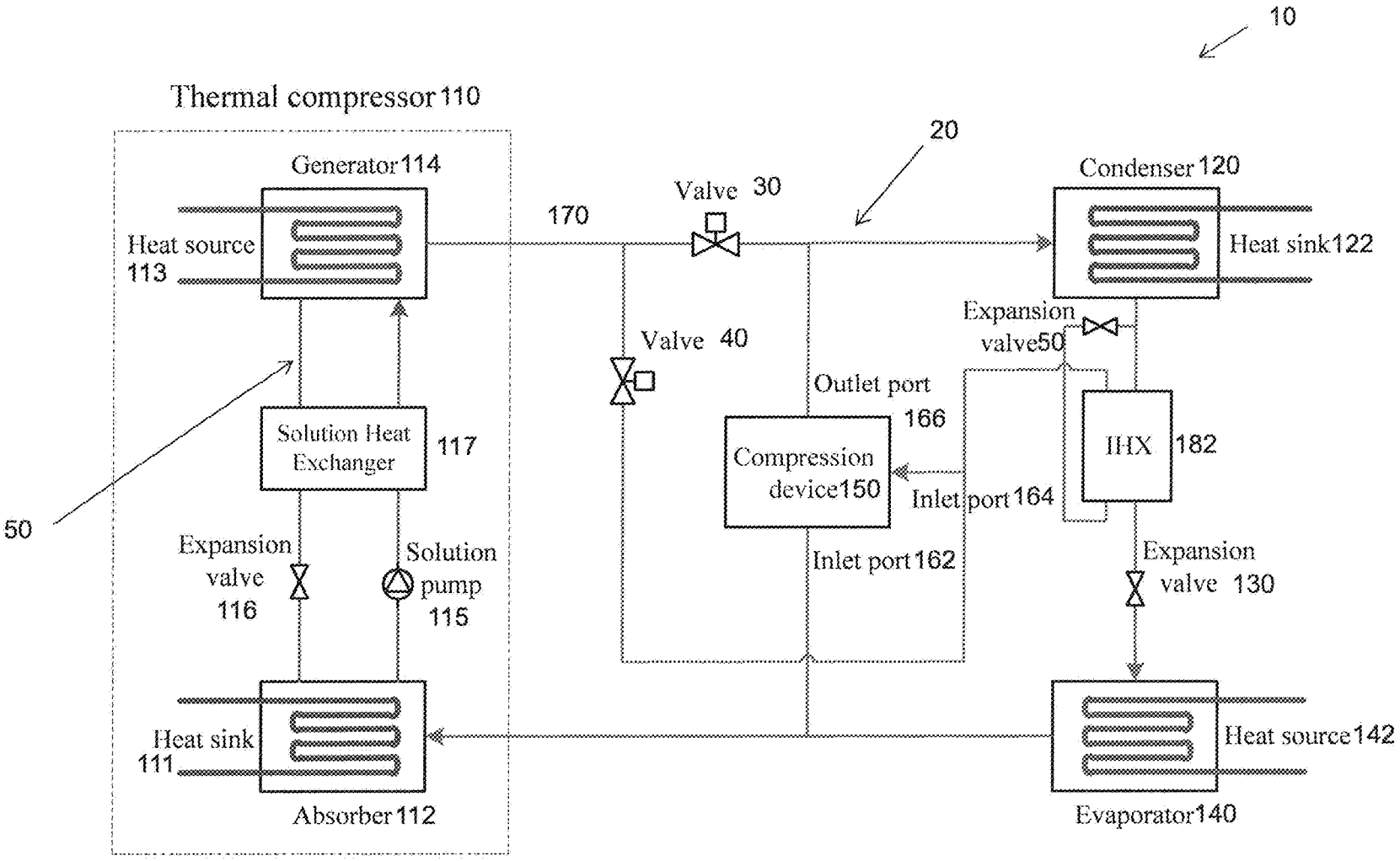
FIG. 1 is a schematic diagram of the hybrid absorption-compression heat pump with refrigerant injection at absorption-side and compression-side (Internal heat exchanger) in one embodiment of the invention.

Without wishing to be bound by theories, the inventors, through their own researches, trials and experiments, have devised that the widely used electrically-driven vapor-compression heat pump and the thermally-driven heat pump have their advantages and disadvantages. The direct combination of the absorption cycle and the compression cycle can combine the advantages of both cycles, but the complex configuration increases the system cost. However, both the absorption and compression heat pumps suffer from deteriorated performance under colder conditions in heating mode and under hotter conditions in cooling mode.

To solve these problems, refrigerant injection technology has been used for the individual vapor-compression heat pump, while compression-assisted technology has been used for the individual absorption heat pump. However, there is no technology to solve the problems for the hybrid absorption-compression heat pump.

In the present invention, a novel hybrid heat pump with refrigerant injection at both absorption-side and compression-side is invented. The compression sub-cycle (compression device) and the absorption sub-cycle (thermal compressor) are installed in parallel and share the condenser, expansion valve and evaporator. The compression device includes a mid-pressure inlet port, which is shared by the twosub-cycles. The compressor has three functions, i.e., compressing a part of the compression-side refrigerant from low pressure to high pressure, compressing the other part of the compression-side refrigerant from middle pressure to high pressure, and compressing the absorption-side refrigerant from middle pressure to high pressure.

The novel heat pump can operate in various modes:

(1) Combined absorption-compression mode. The design proportions of the compression sub-cycle and the absorption sub-cycle can be adjusted by the mid-pressure inlet port to accommodate the supply-side capacity profiles and demand-side load profiles, to maximize primary energy efficiencies, to minimize heat pump oversizing, or to reach annual rejection-and-extraction heat balance.

(2) Single compression mode with the absorption sub-cycle bypassed. This mode can be used when the thermal energy (from solar source, geothermal source, waste source, fossil fuel, etc.) is not available or not preferred, with the system powered by electricity from the grid or by mechanical energy from the fuel engine.

(3) Single absorption mode with the compression sub-cycle bypassed. This mode can be used when the electrical energy or mechanical energy is not available or not preferred.

In addition, the hybrid absorption-compression cycle includes the cycles with and without refrigerant injection at either absorption-side or compression-side. Moreover, the single compression cycle includes cycles with or without refrigerant injection at compression-side. These modes can be operated alternatively depending on the actual situations.

Referring to FIGS. 1 to 12, there is provided a hybrid heat pump system 10 comprising: first compression means 110 operable to form a refrigerant 20 in vapor form and increases the pressure of the refrigerant vapour 20, condensing means 120 arranged to receive the pressurized vapour 20 and condenses the vapor 20 under pressure to a liquid 20, pressure reduction means 130 through which the liquid refrigerant 20 leaving the condensing means 120 passes to reduce the pressure of the liquid 20 to form a mixture of liquid and vapor refrigerant 20, evaporator means 140 arranged to receive the mixture of liquid and vapor refrigerant 20 that passes through the pressure reduction means 130 to evaporate the remaining liquid 20 to form first and second portions of refrigerant vapour 20, second compression means 150 including two, first and second inlet ports 162, 164 and an outlet port 166 and operable to receive at least a portion of the refrigerant vapor 20 from the evaporator means 140, the pressurized vapor 20 from the first compression means 110, and the vapor refrigerant 20 from the condensing means 120 through the first and second inlet ports 162, 164 respectively, increase the pressure thereof, and pass the pressurized vapor 20 to the condensing means 120 through the outlet port 166, and a conduit 170 operable to pass a portion of the refrigerant vapor 20 leaving the first compression means 110 to the second compression means 150.

The overall configuration of the hybrid heat pump system 10 is depicted in FIG. 1. Essentially, the hybrid heat pump system 10 includes first compression means 110, condensing means 120, pressure reduction means 130 and evaporator means 140, and second compression means 150 through which a refrigerant 20 is circulated in cycles.

The condensing means 120 is in fluid communication with a heat sink 122 for cooling the refrigerant 20 before entering the pressure reduction means 130. The evaporator means 140 is in fluid communication with a heat source 142 for heating the refrigerant 20 leaving the pressure reduction means 130. There is also provided a conduit 170 operable to pass a portion of the refrigerant vapour 20 leaving the first compression means 110 to the second compression means 150.

The first and second compression means 110 and 150 are connected in parallel configuration with and share the condensing means 120, the pressure reduction means 130 and the evaporator means 140, thereby forming a hybrid vapor compression-absorption cycle with a compression sub-cycle driven by the compression device 150 and an absorption sub-cycle driven by the thermal compressor 110.

Preferably, the first compression means 110 may be a thermal compressor and further includes an absorber 112 for forming a mixture of the refrigerant 20 and a solution 50 i.e. an absorbent. The generator 114 receives the mixture from the absorber 112 and heats the mixture to separate refrigerant 20, in vapor form, from the absorbent 50. The absorber 112 is in fluid communication with a heat sink 111 for cooling the mixture and the generator 114 is in fluid communication with a heat source 113 for heating the mixture respectively. The first compression means 110 further includes a solution pump 115 for increasing the pressure of the mixture and pumping the mixture to the generator 114, and an expansion valve 116 for reducing the pressure of the mixture. There is further provided a solution heat exchanger 117 which transfer some heat from the mixture leaving the generator 114 to the mixture leaving the pump 115. Finally, the mixture leaving the generator 114 is throttled by the expansion valve 116 to the absorber pressure.

Preferably, the second compression means 150 includes two, first and second inlet ports 162 and 164 and an outlet port 166. The second compression means 150 may be in fluid communication with the evaporator means 140 and the generator 114 through the first and second inlet ports 162 and 164 respectively at the upstream and in fluid communication with the condensing means 120 at the downstream. The generator 114 may also be in fluid communication with the condensing means 120 directly. The first inlet port 162 is at a low pressure, the second inlet port 164 is at a medium pressure, and the outlet port 166 is at a high pressure respectively.

The refrigerant 20 from the evaporator 140 divides into two streams, with one flowing into the absorber 112 of the absorption sub-cycle directly and the other flowing into the compression device 150 of the compression sub-cycle through the first inlet port 162.

Advantageously, the refrigerant 20 generated from the absorption sub-cycle flows into the mid-pressure port 164 of the compression device 150 instead of flowing into the shared condenser 120 directly. Under decreased generation pressure (medium pressure versus high pressure), the absorption sub-cycle could be driven by lower-temperature heat sources 113, as well as work under lower evaporating temperatures and higher heat sink temperatures. Meanwhile, the compression-side refrigerant injection further improves the performance of the compression sub-cycle.

The pressure of the refrigerant vapor from the generator 114 is increased by the second compression means 150, thereby decreasing the required generation pressure at the generator 114. The two streams with different pressure levels are received through the first and second inlet ports 162, 164 and merged in the compression device 150. In particular, the low-pressure refrigerant from the first inlet port 162 is first pressurized to mid-pressure, and then merges with the mid-pressure refrigerant from the second inlet port 164. Then, the mixed refrigerant is pressurized together to high-pressure and discharged at the outlet port 166. The discharge refrigerant 20 leaving the compression device 150 in turn flows into the condenser 120.

There is also provided two, first and second valves 30, 40 for regulating the flow of the refrigerant 20 from the generator 114 to the condenser 120, thereby operating the heat pump system 10 at different modes. The fluid communication between the generator 114 of the first compression means 110 and the condensing means 120 is manipulated by the first valve 30.

The fluid communication between the generator 114 of the first compression means 110 and the second inlet port 164 of the second compression means 150 is manipulated by the second valve 40.

The operating mode can be various depending on the operating conditions. By switching valve 30, valve 40 and expansion valve 50, the novel heat pump can operate at single absorption cycle, single compression cycle, and hybrid absorption-compression cycle. In addition, the hybrid absorption-compression cycle includes the cycles with and without refrigerant injection at either absorption-side or compression-side. Moreover, the single compression cycle includes cycles with or without refrigerant injection at compression-side.

Figure 6:
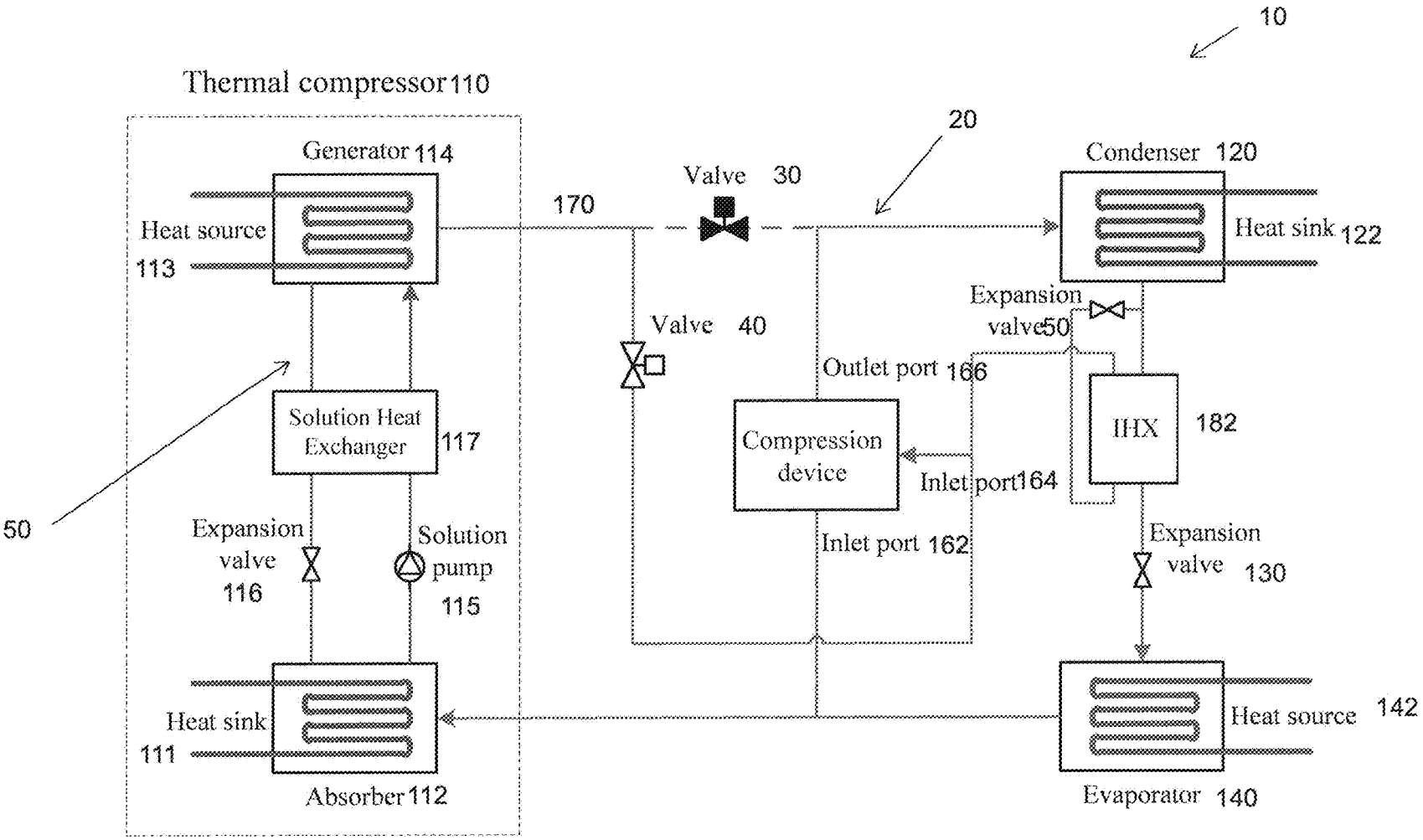
FIG. 6 is a schematic diagram of the hybrid absorption-compression heat pump of FIG. 1 operated in hybrid absorption-compression cycle mode with two-side refrigerant injection.
Figure 7:
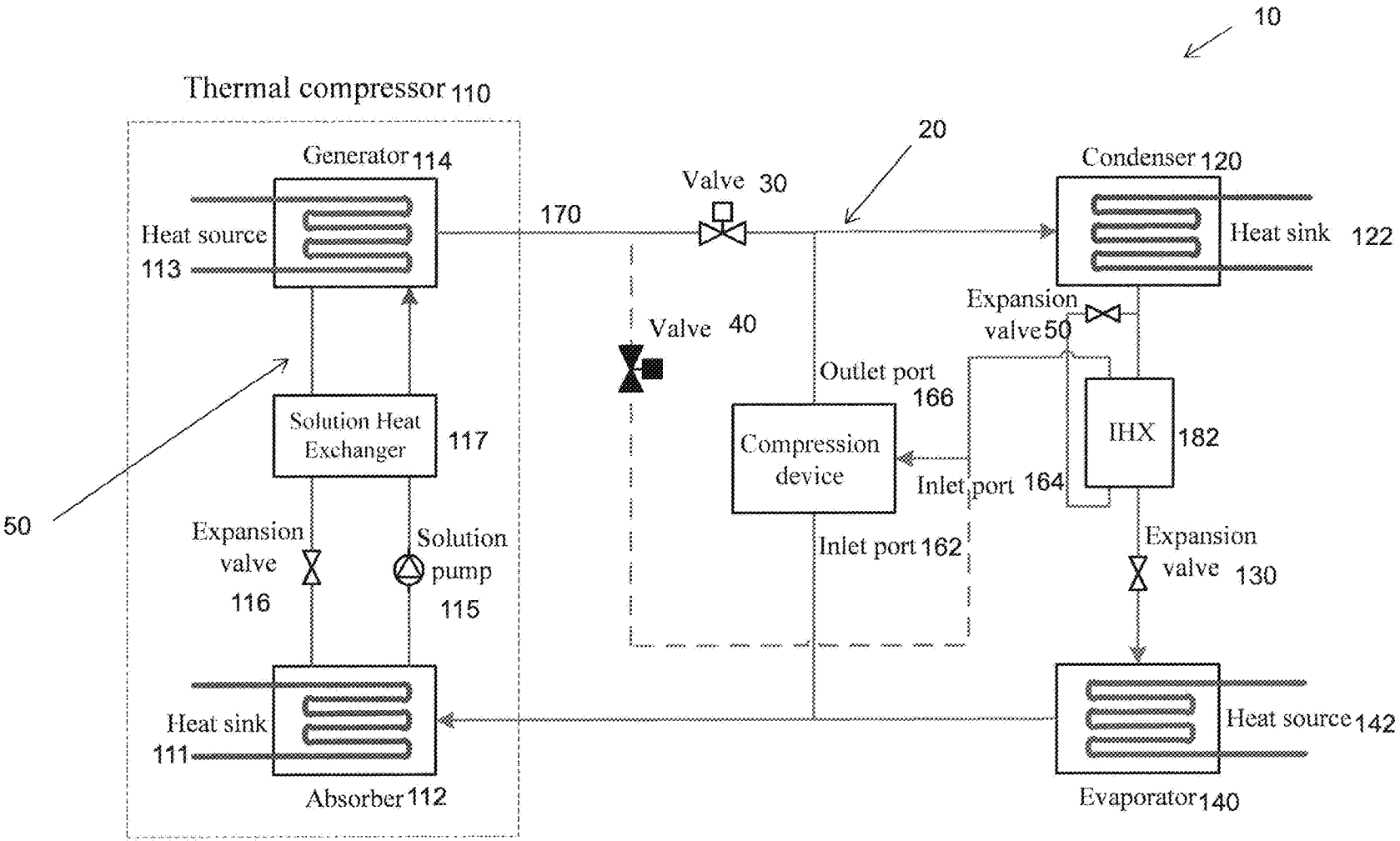
FIG. 7 is a schematic diagram of the hybrid absorption-compression heat pump of FIG. 1 operated in hybrid absorption-compression cycle mode with only compression-side refrigerant injection.
Figure 8:
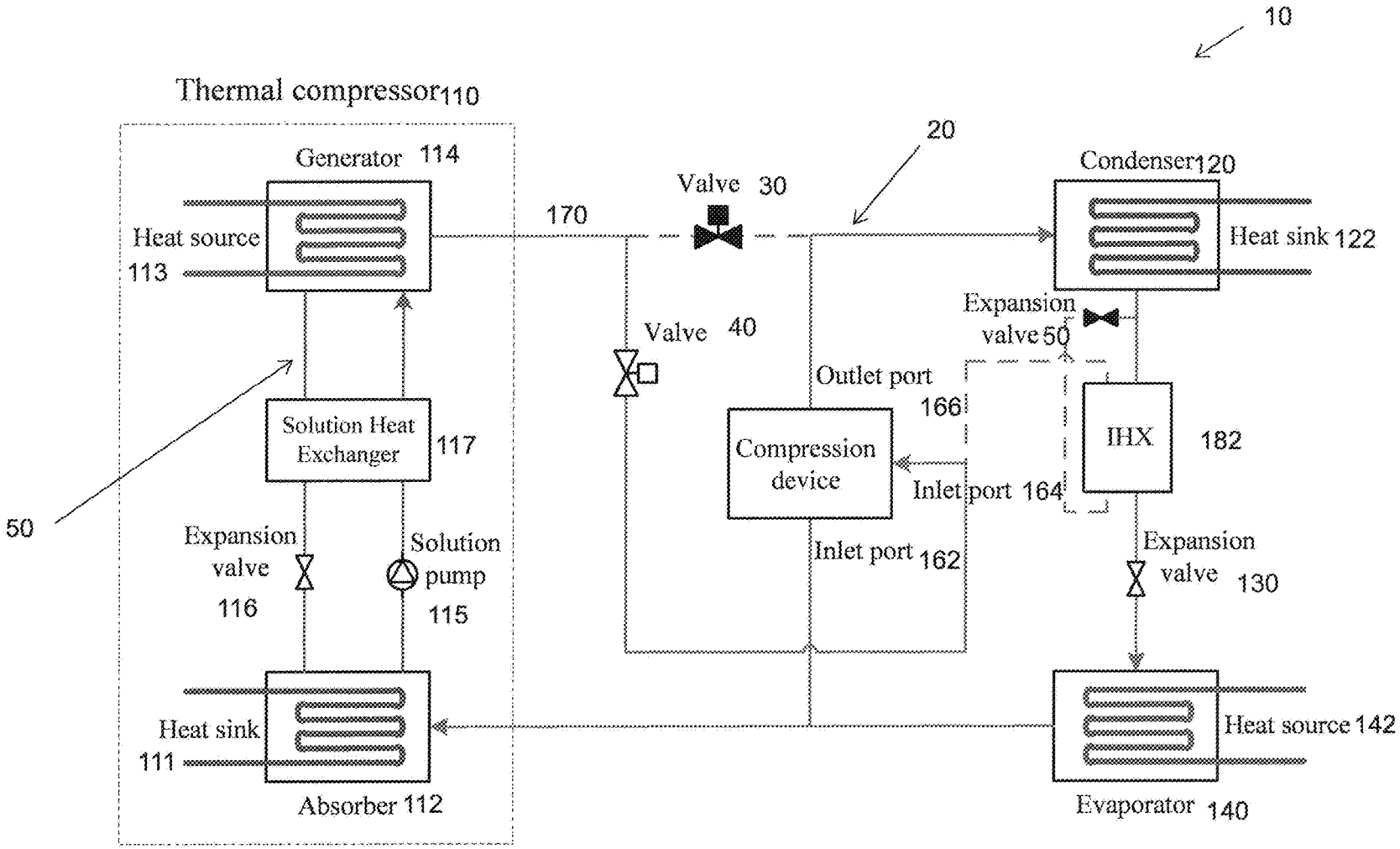
FIG. 8 is a schematic diagram of the hybrid absorption-compression heat pump of FIG. 1 operated in hybrid absorption-compression cycle mode with only absorption-side refrigerant injection.
Figure 9:
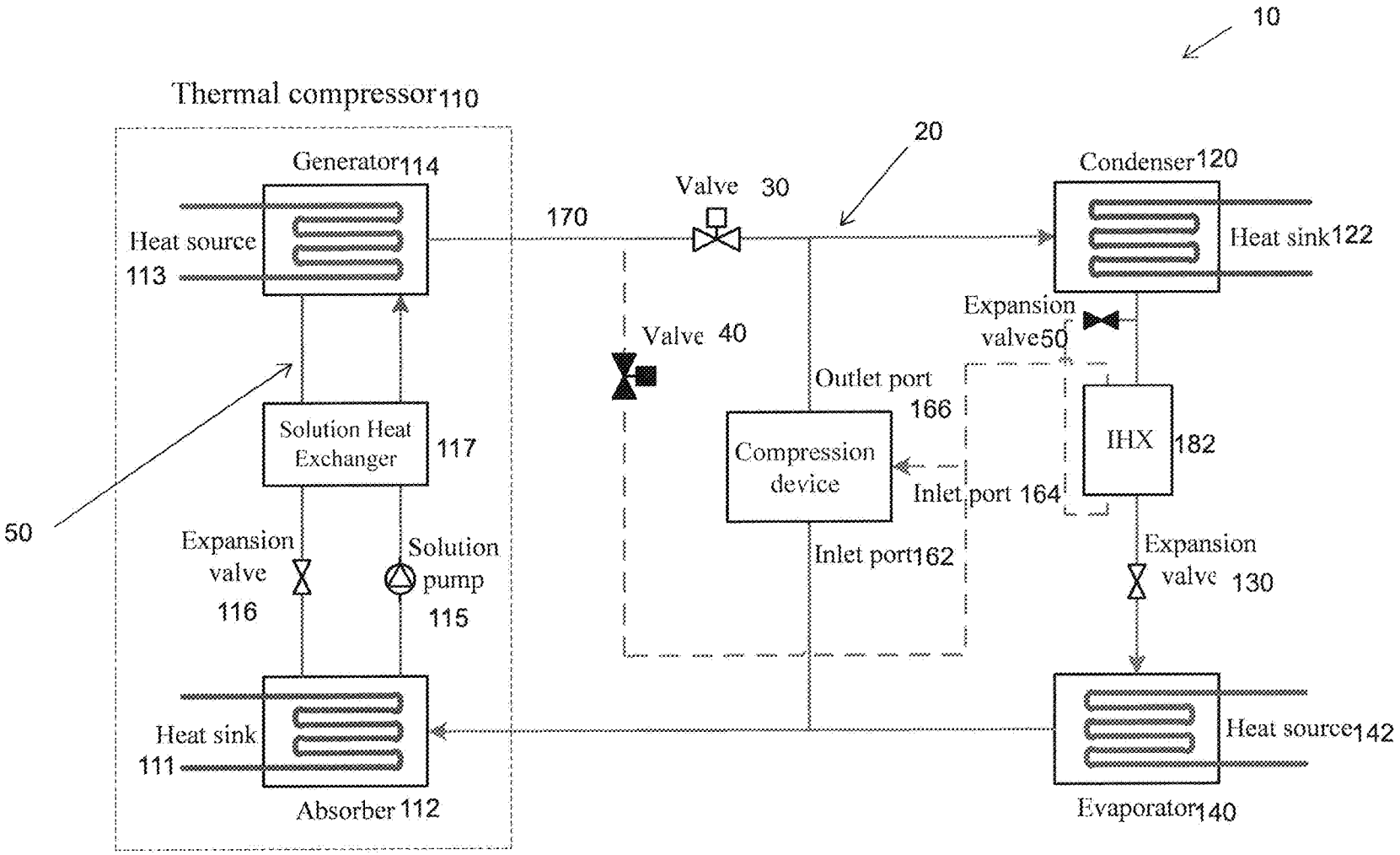
FIG. 9 is a schematic diagram of the hybrid absorption-compression heat pump of FIG. 1 operated in hybrid absorption-compression cycle mode without refrigerant injection.

In particular, mode 1 operates as a hybrid heat pump system 10 with two-side refrigerant injection when the first valve 30 is closed, the second valve 40 is open and the expansion valve 50 is open (as shown in FIG. 6). Mode 2 operates as a hybrid heat pump system 10 with only compression-side refrigerant injection when the first valve 30 is open, the second valve 40 is closed and the expansion valve 50 is open (as shown in FIG. 7). Mode 3 operates as a hybrid heat pump system 10 with only absorption-side refrigerant injection when the first valve 30 is closed, the second valve 40 is open and the expansion valve 50 is closed (as shown in FIG. 8). Mode 4 operates as a hybrid heat pump system 10 without refrigerant injection when the first valve 30 is open, the second valve 40 is closed and the expansion valve 50 is closed (as shown in FIG. 9).

Figure 10:
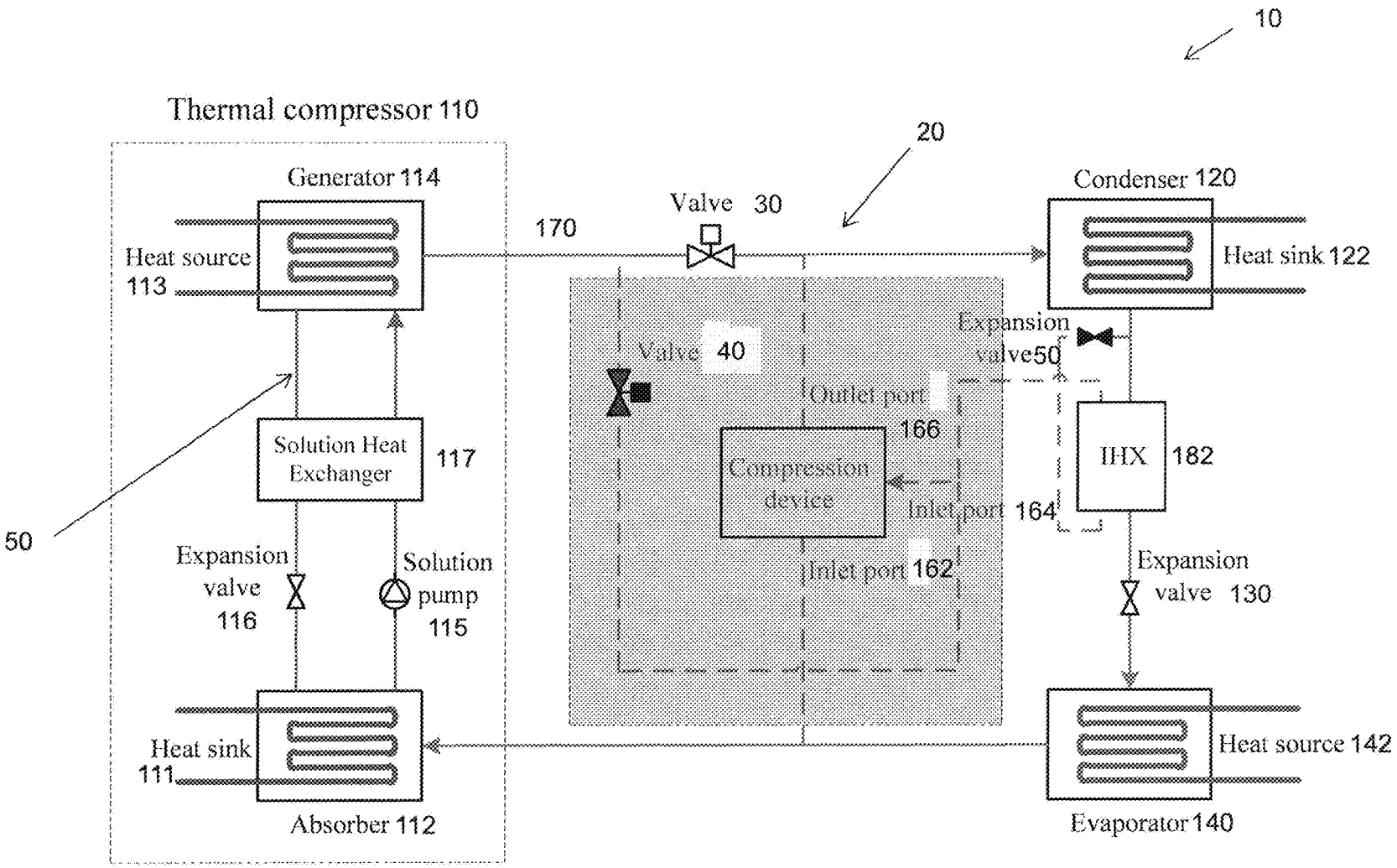
FIG. 10 is a schematic diagram of the hybrid absorption-compression heat pump of FIG. 1 operated in single absorption cycle mode.

The first and second valves 30, 40 and the expansion valve 50 may also be operated in cooperation with the first and compression means 110 and 150 for operating the system 10 like a conventional absorption or compression cycle. Mode 5 operates as a single absorption cycle mode when the first valve 30 is open, the second valve 40 is closed, the expansion valve 50 is closed and the second compression means 150 is deactivated (as shown in FIG. 10).

Figure 11:
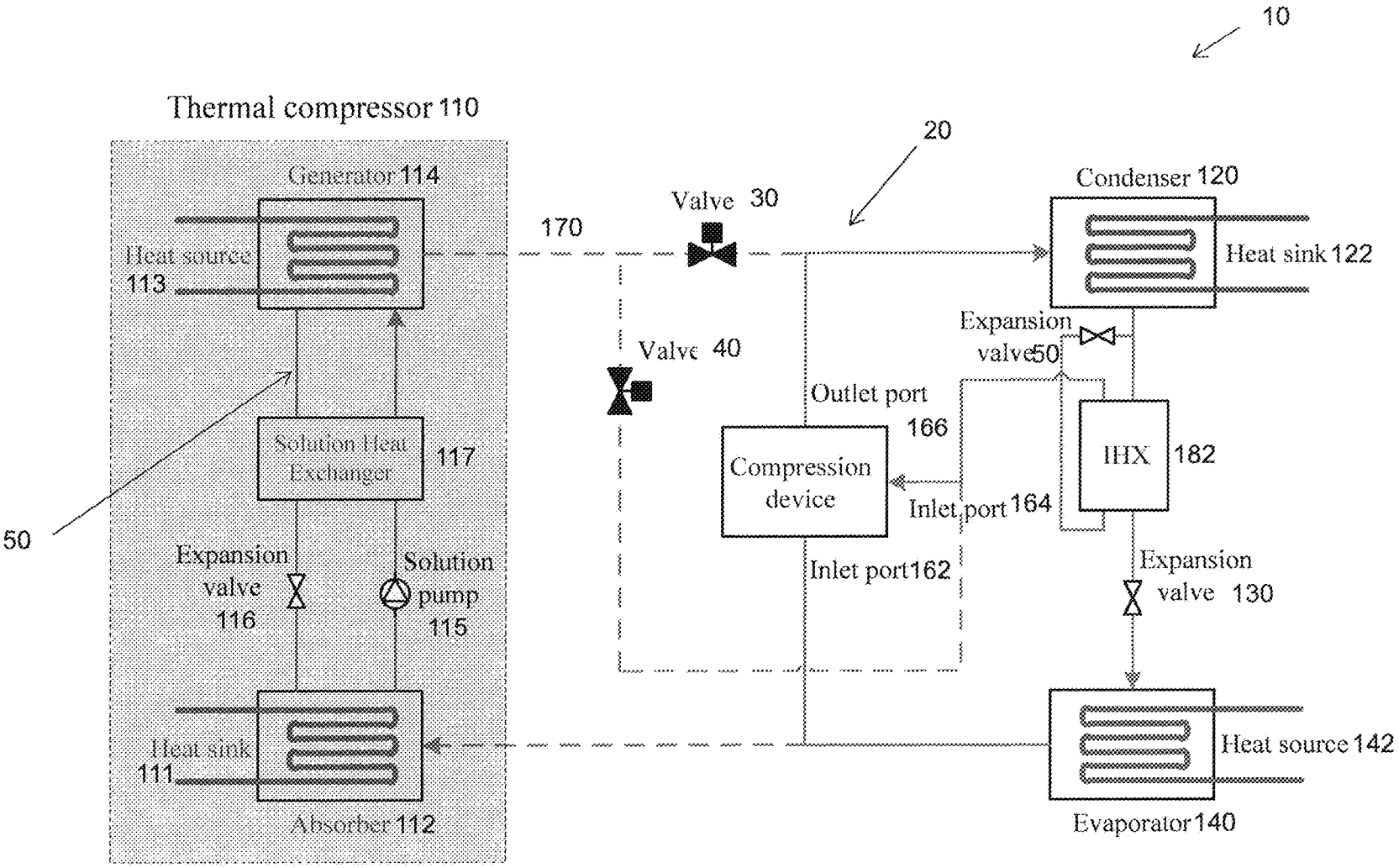
FIG. 11 is a schematic diagram of the hybrid absorption-compression heat pump of FIG. 1 operated in single compression cycle mode with refrigerant injection.
Figure 12:
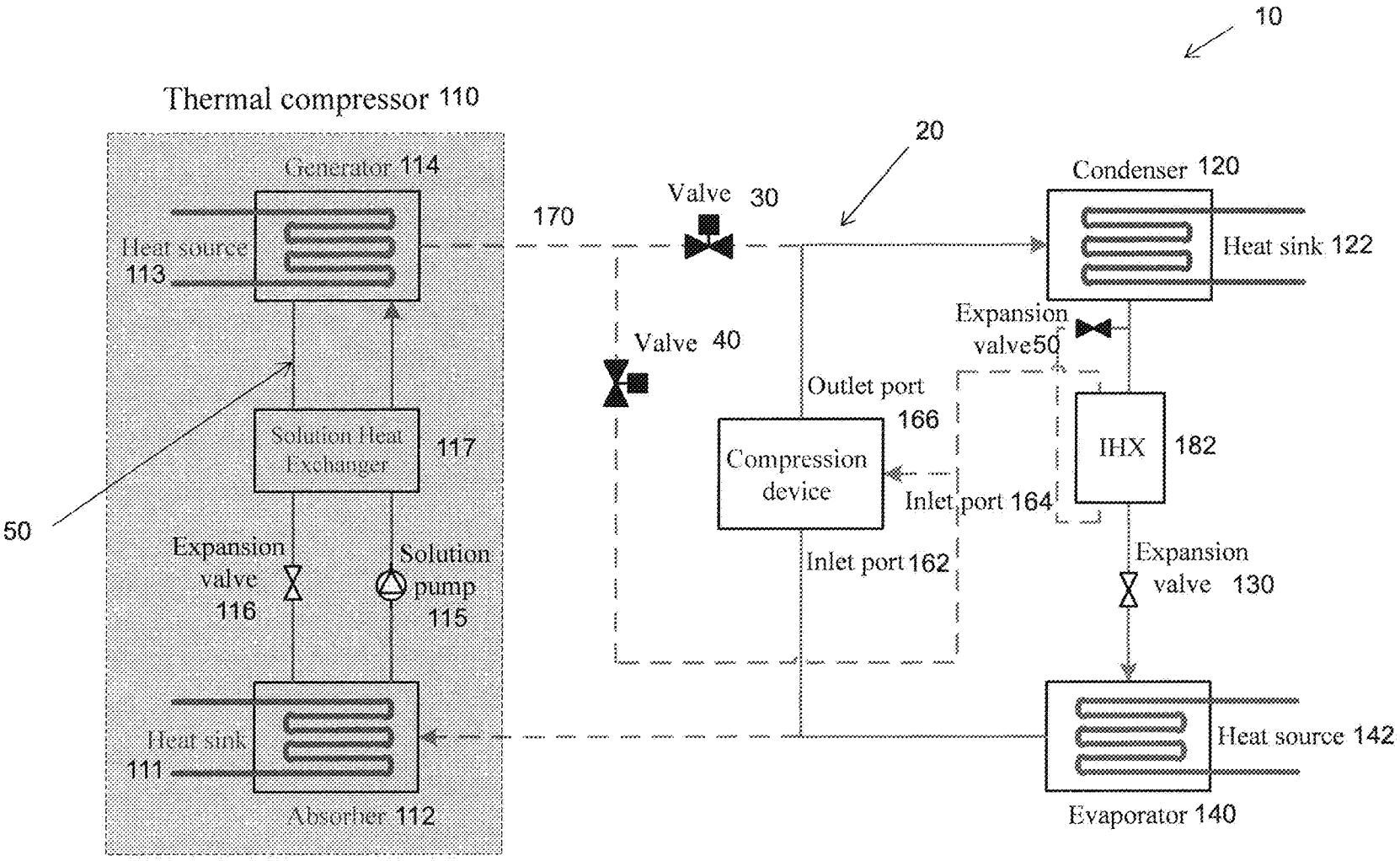
FIG. 12 is a schematic diagram of the hybrid absorption-compression heat pump of FIG. 1 operated in single compression cycle mode without refrigerant injection.

Mode 6 operates as a single compression cycle mode with refrigerant injection when the first valve 30 is closed, the second valve 40 is closed, the expansion valve 50 is open and the first compression means 110 is deactivated (as shown in FIG. 11). Mode 7 operates as a single compression cycle mode without refrigerant injection when the first valve 30 is closed, the second valve 40 is closed, the expansion valve 50 is closed and the first compression means 110 is deactivated (as shown in FIG. 12).

More preferably, the refrigerant 20 from the condenser 120 divides into two streams, with one flowing into an internal heat exchanger (IHX) 182 directly and the other flowing into the IHX 182 after being throttled in Expansion valve 50. The stream leaving the IHX 182 subsequently merges with the refrigerant 20 leaving the generator 114 of the first compression means 110 before introducing into the second compression means 150 through the second inlet port 164.

Figure 2:
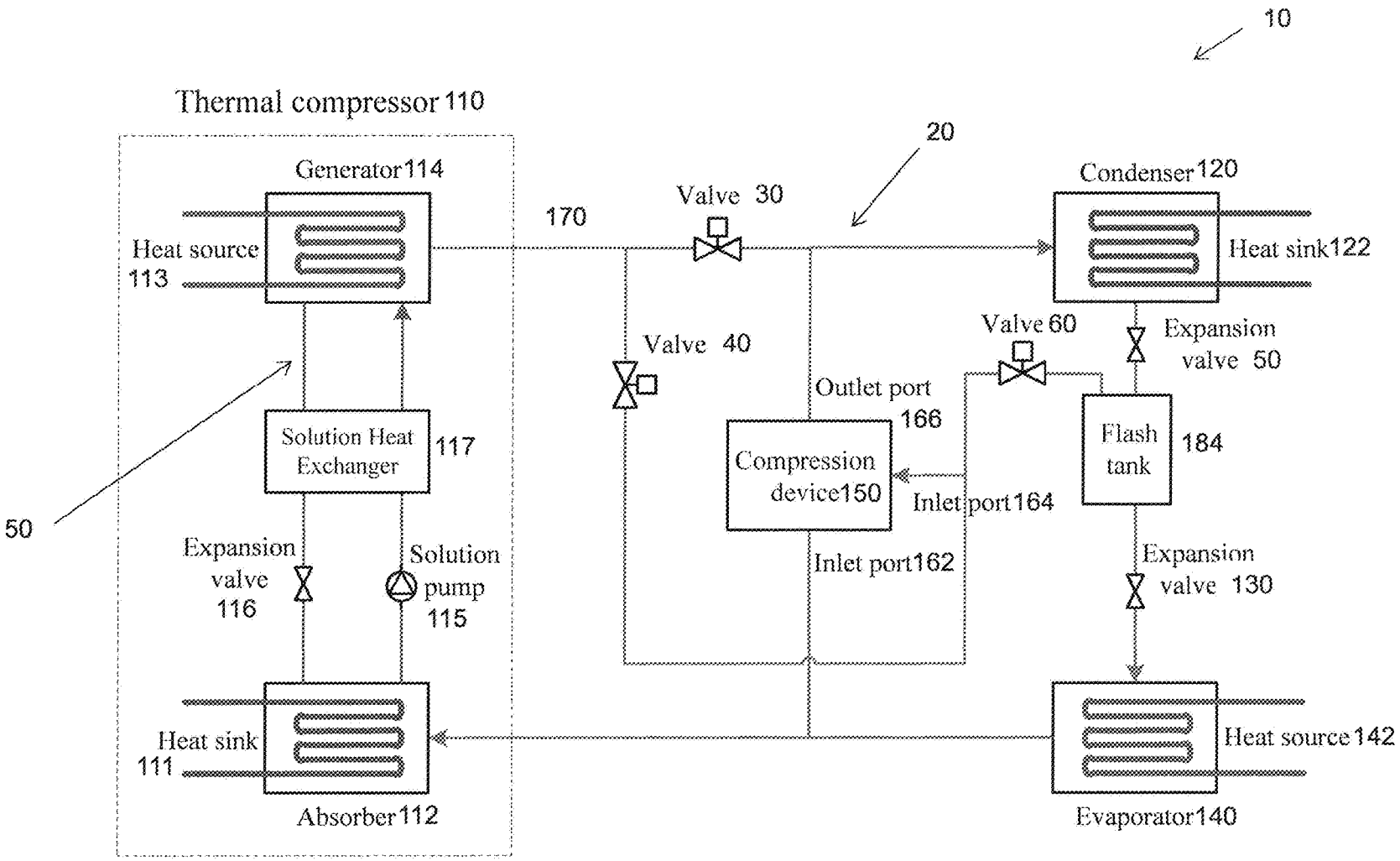
FIG. 2 is a schematic diagram of the hybrid absorption-compression heat pump with refrigerant injection at absorption-side and compression-side (Flash tank) in one embodiment of the invention.

In an alternative embodiment as shown in FIG. 2, the refrigerant 20 from the condenser 120 may be introduced to a Flash tank 184 after being throttled in Expansion valve 50 for the refrigerant injection purpose in the compression sub-cycle. There is further provided an additional valve 60 for regulating the flow of the refrigerant 20 to the second compression means 150 leaving from the flash tank 184. The stream leaving the additional valve 60 subsequently merges with the refrigerant 20 leaving the generator 114 of the first compression means 110 before introducing into the second compression means 150 through the second inlet port 164.

Figure 3:
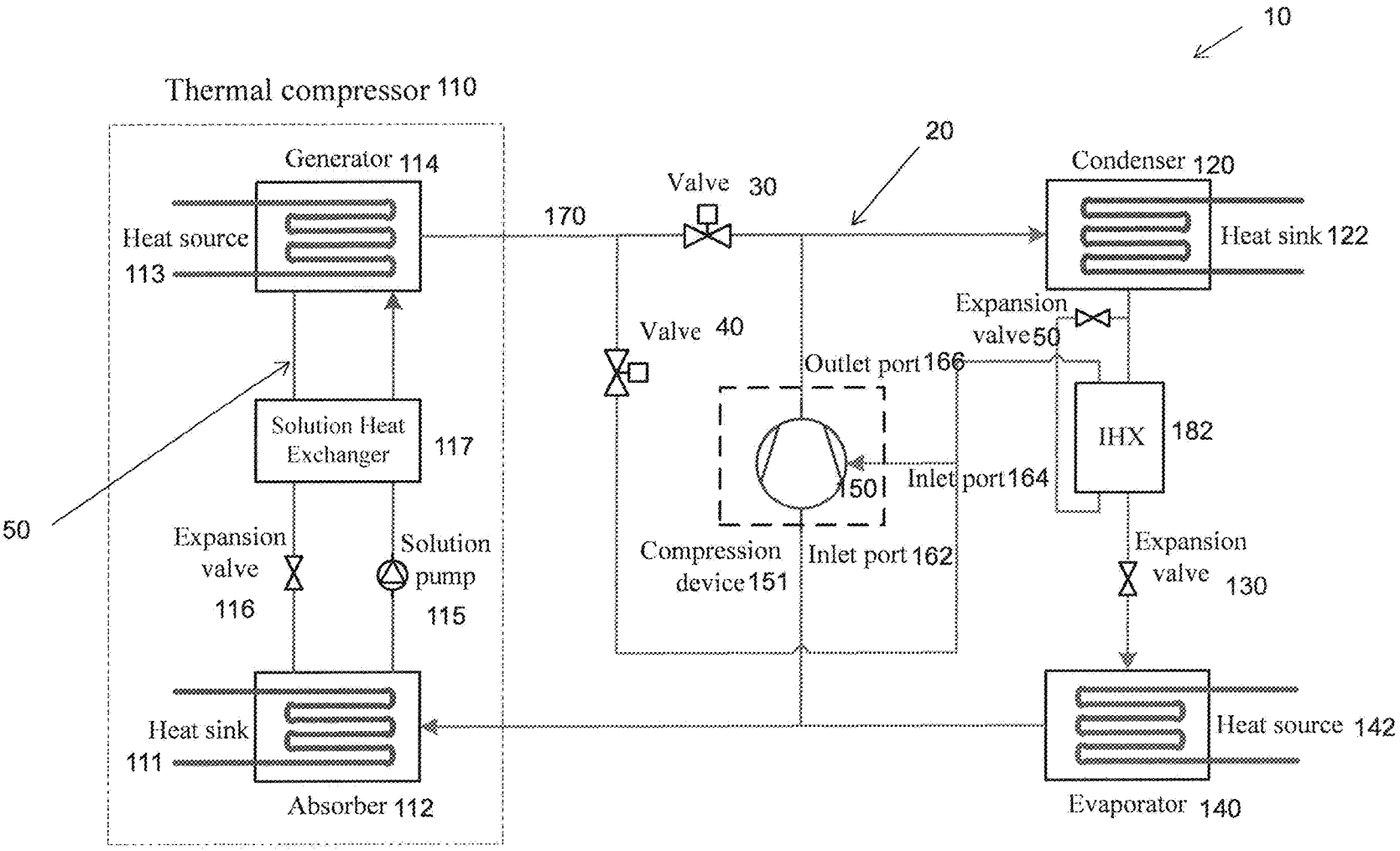
FIG. 3 is a schematic diagram of the hybrid absorption-compression heat pump of FIG. 1 with injection-type compressor.
Figure 4:
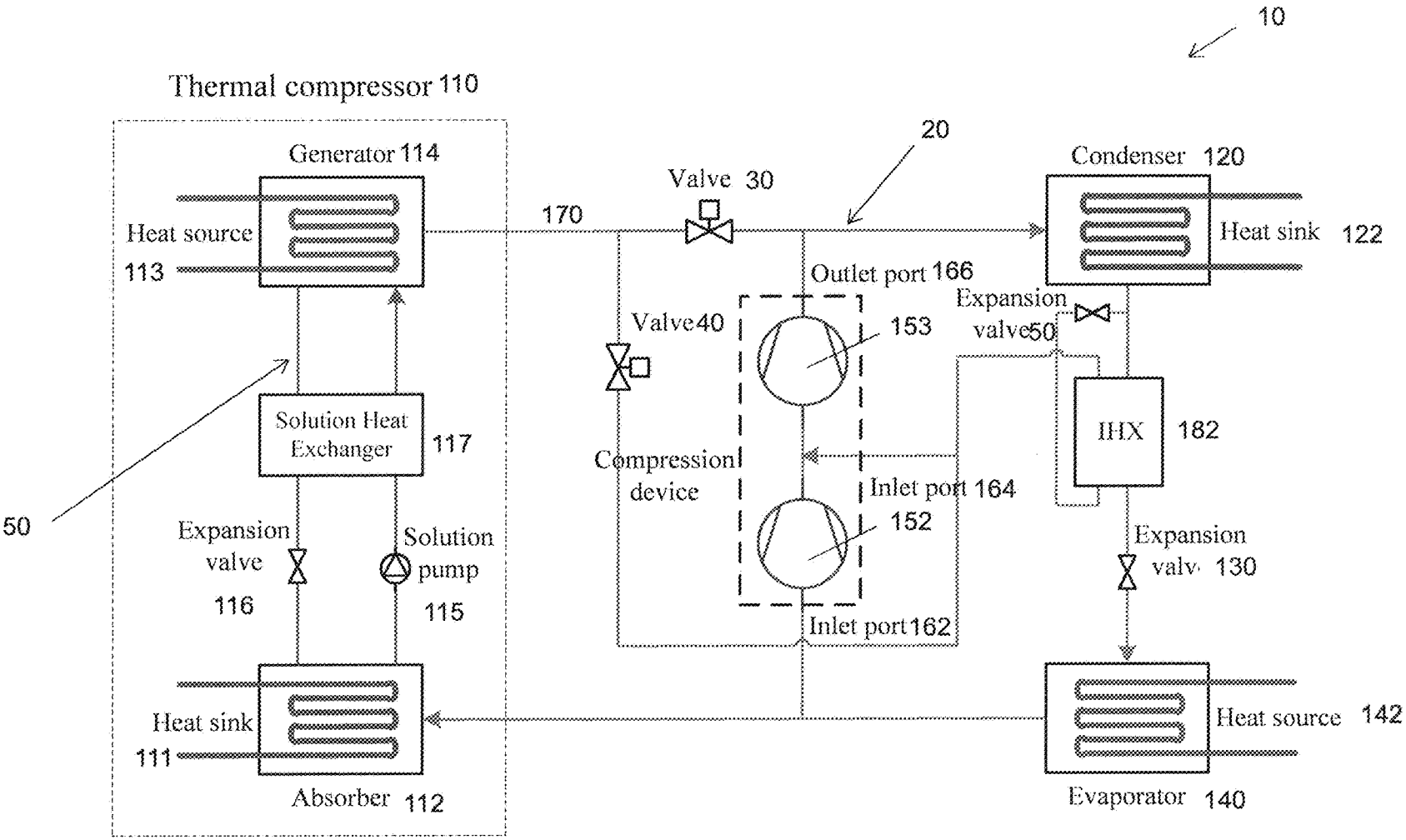
FIG. 4 is a schematic diagram of the hybrid absorption-compression heat pump of FIG. 1 with single-shell two-stage compressor or serially-connected compressors.
Figure 5:
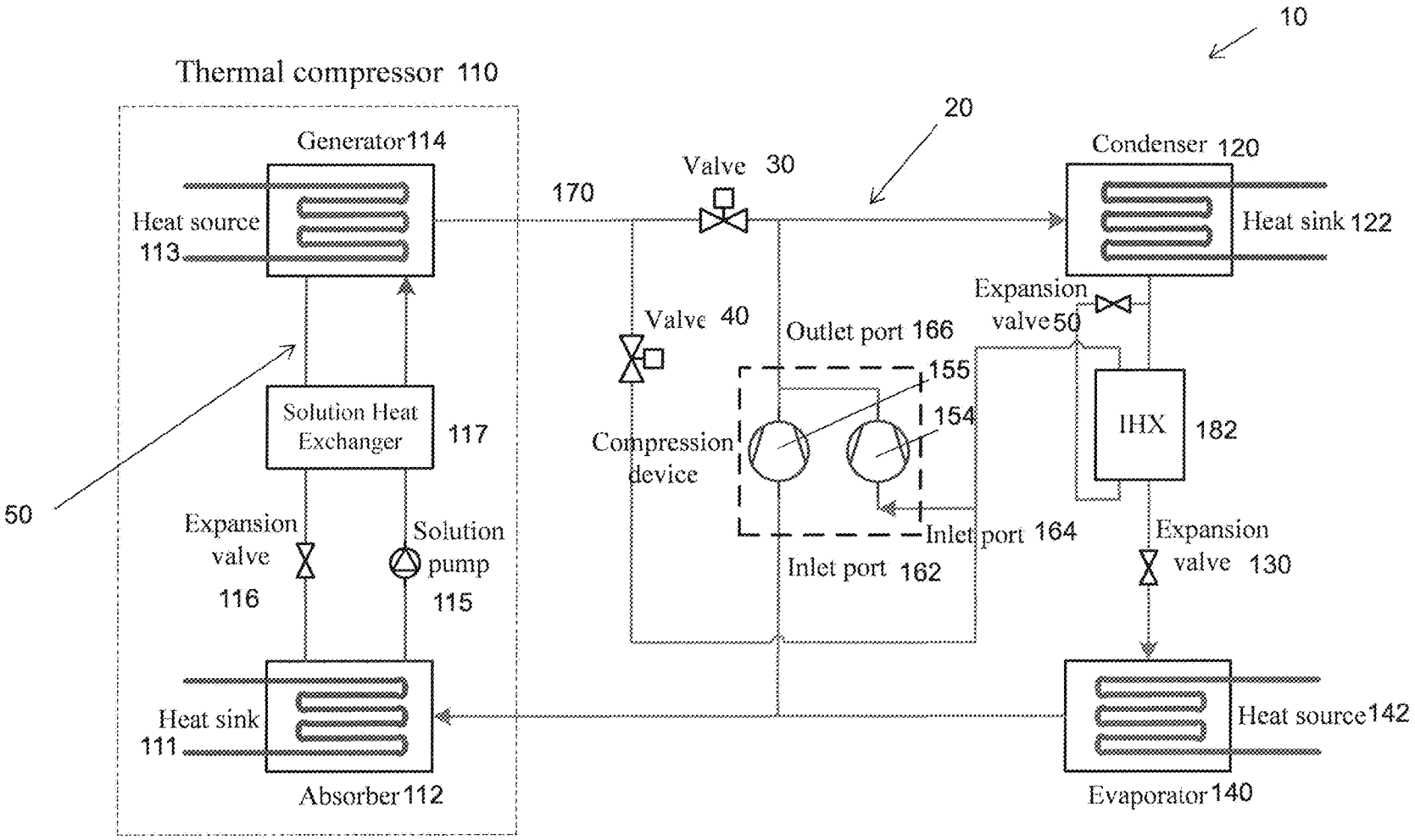
FIG. 5 is a schematic diagram of the hybrid absorption-compression heat pump of FIG. 1 with single-shell dual-cylinder compressor or parallelly-connected compressors.

Preferably, the flow path of the second compression means 150 may be modified for different compressors, such as an injection-type compressor (as shown in FIG. 3), a single-shell two-stage compressor or a single-shell dual-cylinder compressor (as shown in FIG. 4), and serially-connected compressors or parallelly-connected compressors (as shown in FIG. 5).

In one embodiment as shown in FIG. 3, the second compression means 150 may be an injection-type compressor 151 for injecting the combination of the pressurized vapor from the generator 114 of the first compression means 110 and the vapor refrigerant from the condensing means 120 to the second compression means 150 through the second inlet port 164. Preferably, the injection-type compressor may be a reciprocating compressor, rolling compressor, scroll compressor, screw compressor, or centrifugal compressor.

In one embodiment as shown in FIG. 4, the second compression means 150 may include a two-stage compressor, whereby a portion of the refrigerant vapor from the evaporator means 140 is introduced to the first stage 152 of the second compression means 150 through the first inlet port 162 and the combination of the pressurized vapor from the generator 114 of the first compression means 110 and the vapor refrigerant from the condensing means 120 is injected between the first stage 152 and the second stage 153 of the second compression means 150 through the second inlet port 164 subsequent to the first stage 152. Preferably, different stages 152, 153 of the single-shell two-stage compressor may be the same type of compressor such as reciprocating compressor, rolling compressor, scroll compressor, screw compressor, or centrifugal compressor or combinations of different types of compressor.

Alternatively, the second compression means 150 may be embodied as two, first and second serially-connected compressors 152, 153, whereby a portion of the refrigerant vapor from the evaporator means 140 is introduced to the first compressor 152 of the second compression means 150 through the first inlet port 162 and the combination of the pressurized vapor from the generator 114 of the first compression means 110 and the vapor refrigerant from the condensing means 120 is injected between the first compressor 152 and the second compressor 153 through the second inlet port 164. Preferably, individual compressors 152, 153 of the serially-connected compressors may be the same type of compressor such as reciprocating compressor, rolling compressor, scroll compressor, screw compressor, or centrifugal compressor or combinations of different types of compressor.

In yet another embodiment as shown in FIG. 5, the second compression means 150 may include a dual-cylinder compressor 154, 155 for each receiving and compressing a portion of the refrigerant vapor 20 from the evaporator means 140 and the combination of the pressurized vapor from the first compression means 110 and the vapor refrigerant from the condensing means 120 individually through the first and second inlet ports 162, 164 and for passing both to the condensing means 120 through the outlet port 166. Preferably, different cylinders 154, 155 of the single-shell dual-cylinder compressor may be the same type of compressor such as reciprocating compressor, rolling compressor, scroll compressor, screw compressor, or centrifugal compressor or combinations of different types of compressor.

Alternatively, the second compression means 150 may be embodied as two, first and second parallelly-connected compressors 154, 155 for each receiving and compressing a portion of the refrigerant vapor from the evaporator means 140 and the combination of the pressurized vapor from the first compression means 110 and the vapor refrigerant from the condensing means 120 individually through the first and second inlet ports 162, 164 and for passing both to the condensing means 120 through the outlet port 166. Preferably, the individual compressors 154, 155 of the parallelly-connected compressors may be the same type of compressor such as reciprocating compressor, rolling compressor, scroll compressor, screw compressor, or centrifugal compressor or combinations of different types of compressor.

In addition, depending on the types of compressors, the compression device 150 can be further extended. For the injection-type compressor 151, it could be reciprocating compressor, rolling compressor, scroll compressor, screw compressor, or centrifugal compressor. For the single-shell two-stage compressor or single-shell dual-cylinder compressor 152, 153, and serially-connected compressors or parallelly-connected compressors 154, 155, different stages, different cylinders or different individual compressors can be the same type (reciprocating compressor, rolling compressor, scroll compressor, screw compressor, or centrifugal compressor) or combinations of different types of compressor.

Referring now to FIG. 6 for the detailed description of the hybrid absorption-compression heat pump 10 operated in hybrid absorption-compression cycle mode with both compression-side and absorption-side refrigerant injection. In the combined absorption-compression mode, the design proportions of the compression sub-cycle and the absorption sub-cycle can be adjusted to accommodate the supply-side capacity profiles and demand-side load profiles, to maximize primary energy efficiencies, to minimize heat pump oversizing, or to reach annual rejection-and-extraction heat balance. When the driving source temperature of heat source 113 is not high enough and the evaporating temperature is low, this mode can be activated by closing valve 30. A portion of the vapor leaving the evaporator means 140 and the combination of the pressurized vapor leaving the first compression means 110 and the vapor refrigerant from the condensing means 120 are received by the second compression means 150 individually through the second and first inlet ports 164, 162 and pressurized by the second compression means 150 and subsequently received through the outlet port 166 and condensed by the condensing means 120.

Referring to FIG. 7 for the detailed description of the hybrid absorption-compression heat pump 10 operated in hybrid absorption-compression cycle mode with only compression-side refrigerant injection i.e. without absorption-side refrigerant injection. When the driving source temperature of heat source 113 is high enough but the evaporating temperature is low, this mode can be activated by closing second valve 40. Meanwhile, the second compression means 150 is adjusted due to the closing of the second inlet port 164. A portion of the vapor leaving the evaporator means 140 and the vapor refrigerant from the condensing means 120 are received through the first and second inlet ports 162, 164 respectively and pressurized by the second compression means 150, and the pressurized vapor leaving the first and second compression means 110, 150 are subsequently condensed by the condensing means 120.

Referring to FIG. 8 for the detailed description of the hybrid absorption-compression heat pump 10 operated in hybrid absorption-compression cycle mode with only absorption-side refrigerant injection i.e. without compression-side refrigerant injection. When the driving source temperature of heat source 113 is not high enough but the evaporating temperature is high, this mode can be activated by closing valve 30 and expansion valve 50. A portion of the vapor leaving the evaporator means 140 and the pressurized vapor leaving the generator 114 of the first compression means 110 are received through the first and second inlet ports 162, 164 respectively and pressurized by the second compression means 150, and the pressurized vapor leaving the first and second compression means 110, 150 are subsequently condensed by the condensing means 120.

Referring to FIG. 9 for the detailed description of the hybrid absorption-compression heat pump 10 operated in hybrid absorption-compression cycle mode without refrigerant injection.

When the driving source temperature of heat source 113 is high enough and the evaporating temperature is also high, this mode can be activated by closing valve 40 and expansion valve 50. A portion of the vapor leaving the evaporator means 140 is received through the first inlet port 162 and pressurized by the second compression means 150, and the pressurized vapor leaving the first and second compression means 110, 150 are subsequently condensed by the condensing means 120.

Referring to FIG. 10 for the detailed description of the hybrid absorption-compression heat pump 10 operated in single absorption cycle mode i.e. single absorption mode with the compression sub-cycle bypassed. This mode can be used when the electrical energy or mechanical energy is not available or not preferred. To activate this mode, the first compression means 110 is activated and the second compression means 150 is deactivated, whereby the refrigerant vapor leaving the evaporator means 140 is received by the absorber 112 of the first compression means 110 directly and subsequently received and condensed by the condensing means 120.

Referring to FIG. 11 for the detailed description of the hybrid absorption-compression heat pump 10 operated in single compression cycle mode with refrigerant injection i.e. single compression mode with the absorption sub-cycle bypassed. This mode can be used when the thermal energy from renewable energy source such as solar source, geothermal source, waste source, fossil fuel, etc. is not available or not preferred with the system powered by electricity from the grid or by mechanical energy from the fuel engine. To activate this mode, the first compression means 110 is deactivated and the second compression means 150 is activated, whereby the refrigerant vapor leaving the evaporator means 140 and the vapor refrigerant from the condensing means 120 are received through the first and second inlet port 162, 164 respectively and pressurized by the second compression means 150 and subsequently received and condensed by the condensing means 120.

Referring finally to FIG. 12 for the detailed description of the hybrid absorption-compression heat pump 10 operated in single compression cycle mode without refrigerant injection. Under the independent compression cycle mode, if the evaporating temperature is high, this mode can be activated by closing expansion valve 50. The first compression means 110 is deactivated and the second compression means 150 is activated, whereby the refrigerant vapor leaving the evaporator means 140 is received through the first inlet port 162 and pressurized by the second compression means 150 and subsequently received and condensed by the condensing means 120.

Overall, the invention provides a very flexible heat pump technology, which can operate at the most efficient mode depending on the actual conditions. Also, the mid-pressure refrigerant injection can greatly decrease the required driving temperature by strengthening the generation process with reduced generating pressure while maintaining the same condensing pressure. This is of great significance to make use of lower-temperature heat sources that otherwise could not be used or had to be used with lower efficiencies. A substantially more renewable energy and waste heat can be efficiently utilized as the driving source of heat pump cycles. In addition, this configuration enables the compression sub-cycle and absorption sub-cycle operate under severe conditions simultaneously, contributing to higher cooling performance in hotter regions and higher heating performance in colder regions.

The refrigerant injection provides high-pressure compression between the generator 114 and the condenser 120 to strengthen the generation process of the absorption sub-cycle, meanwhile decreases the evaporator inlet enthalpy of the compression sub-cycle. The second inlet port 164 determines the pressure lifts of both sub-cycles and can be optimized under various working conditions.

This novel technology has great potentials for energy saving in a wide range of applications. For instance, it can be used for electrically-thermally-driven heat pumps under various application scenarios such as space cooling, space heating and water heating for energy saving.

In addition, this invention can also be used for cooling applications with lower cooling temperatures or in hotter climates, for heating applications with higher heating temperatures or in colder climates, as well as for both cooling and heating applications with lower driving temperatures.

It can be well used for hybrid-energy heat pumps for peak-load shaving of the electrical power grid, for higher cooling performance in hotter regions and higher heating performance in colder regions.

It can be well used for photovoltaic/thermal heat pumps to increase the overall solar energy efficiency and thus reduce the solar panel installation area.

It can also be used for gas-fired hybrid heat pumps to improve the overall energy efficiency by deep heat recovery from the exhaust flue gas.

It will be appreciated by persons skilled in the art that numerous variations and/or modifications may be made to the present invention as shown in the specific embodiments without departing from the spirit or scope of the invention as broadly described. The present embodiments are, therefore, to be considered in all respects as illustrative and not restrictive.

It will also be appreciated by persons skilled in the art that the present invention may also include further additional modifications made to the hybrid heat pump system which does not affect the overall functioning of the hybrid heat pump system.

Any reference to prior art contained herein is not to be taken as an admission that the information is common general knowledge, unless otherwise indicated. It is to be understood that, if any prior art information is referred to herein, such reference does not constitute an admission that the information forms a part of the common general knowledge in the art, any other country.

The invention claimed is:

1. A hybrid heat pump system comprising:

first compression means operable to form a refrigerant in vapor form and increases the pressure of the refrigerant vapor;

condensing means arranged to receive the pressurized vapor and condense the vapor under pressure to a liquid;

pressure reduction means through which the liquid refrigerant leaving the condensing means passes to reduce the pressure of the liquid to form a mixture of liquid and vapor refrigerant;

evaporator means arranged to receive the mixture of liquid and vapor refrigerant that passes through the pressure reduction means to evaporate the remaining liquid to form first and second portions of refrigerant vapor;

second compression means including a two-stage compressor, a first inlet port, a second inlet port, and an outlet port, the second compression means being operable to:

receive, through the first inlet port or the second inlet port, at least a portion of the refrigerant vapor from the evaporator means at the first stage of the two-stage compressor, and the combination of the pressurized vapor from the first compression means and the vapor refrigerant from the condensing means between the first stage and the second stage of the two-stage compressor subsequent to the first stage;

increase the pressure thereof; and pass the pressurized vapor to the condensing means through the outlet port; and a conduit operable to pass a portion of the refrigerant vapor leaving the first compression means to the second compression means.

2. The system of claim 1, wherein the two-stage compressor further includes an injection-type compressor for injecting the combination of the pressurized vapor from the first compression means and the vapor refrigerant from the condensing means to the two-stage compressor.

3. The system of claim 1, wherein the pressure at the outlet port is higher than that at the first and second inlet ports, and the pressure at the second inlet port is higher than that at the first inlet port.

4. The system of claim 1, wherein a portion of the vapor leaving the evaporator means and the combination of the pressurized vapor leaving the first compression means and the vapor refrigerant from the condensing means are received by the second compression means individually and pressurized by the second compression means and subsequently condensed by the condensing means.

5. The system of claim 1, wherein a portion of the vapor leaving the evaporator means and the vapor refrigerant from the condensing means are received and pressurized by the second compression means, and the pressurized vapor leaving the first and second compression means are subsequently condensed by the condensing means.

6. The system of claim 1, wherein a portion of the vapor leaving the evaporator means and the pressurized vapor leaving the first compression means are received and pressurized by the second compression means, and the pressurized vapor leaving the second compression means is subsequently condensed by the condensing means.

7. The system of claim 1, wherein a portion of the vapor leaving the evaporator means is received and pressurized by the second compression means, and the pressurized vapor leaving the first and second compression means are subsequently condensed by the condensing means.

8. The system of claim 1, wherein the first compression means is activated and the second compression means is deactivated, whereby the refrigerant vapor leaving the evaporator means is received by the first compression means and subsequently received and condensed by the condensing means.

9. The system of claim 1, wherein the first compression means is deactivated and the second compression means is activated, whereby the refrigerant vapor leaving the evaporator means and the vapor refrigerant from the condensing means are received and pressurized by the second compression means and subsequently received and condensed by the condensing means.

10. The system of claim 1, wherein the first compression means is deactivated and the second compression means is activated, whereby the refrigerant vapor leaving the evaporator means is received and pressurized by the second compression means and subsequently received and condensed by the condensing means.

11. The system of claim 1, wherein the fluid communication between the first compression means and the condensing means is manipulated by a first valve and the fluid communication between the first and second compression means is manipulated by a second valve.

12. The system of claim 1, wherein each of the first stage and the second stage of the two-stage compressor includes at least one of reciprocating compressor, rolling compressor, scroll compressor, screw compressor, and centrifugal compressor.

13. The system of claim 1, wherein the first compression means further includes:

an absorber that forms a mixture of a refrigerant and an absorbent; and a generator that receives the mixture from the absorber and heats the mixture to separate refrigerant, in vapor form, from the absorbent.

14. The system of claim 13, wherein the pressure of the refrigerant vapor from the generator is increased by the second compression means.

15. A hybrid heat pump system comprising:

first compression means operable to form a refrigerant in vapor form and increases the pressure of the refrigerant vapor;

condensing means arranged to receive the pressurized vapor and condense the vapor under pressure to a liquid;

pressure reduction means through which the liquid refrigerant leaving the condensing means passes to reduce the pressure of the liquid to form a mixture of liquid and vapor refrigerant;

evaporator means arranged to receive the mixture of liquid and vapor refrigerant that passes through the pressure reduction means to evaporate the remaining liquid to form first and second portions of refrigerant vapor;

second compression means including first and second serially-connected compressors, a first inlet port, a second inlet port and an outlet port, the second compression means being operable to:

receive, through the first inlet port or the second inlet port, at least a portion of the refrigerant vapor from the evaporator means at the first compressor of the first and second serially-connected compressors, and the combination of the pressurized vapor from the first compression means and the vapor refrigerant from the condensing means between the first and second serially-connected compressors;

increase the pressure thereof; and pass the pressurized vapor to the condensing means through the outlet port; and a conduit operable to pass a portion of the refrigerant vapor leaving the first compression means to the second compression means.

16. The system of claim 15, wherein the first and second serially-connected compressors further include an injection-type compressor for injecting the combination of the pressurized vapor from the first compression means and the vapor refrigerant from the condensing means to the first and second serially-connected compressors.

17. The system of claim 15, wherein the pressure at the outlet port is higher than that at the first and second inlet ports, and the pressure at the second inlet port is higher than that at the first inlet port.

18. The system of claim 15, wherein a portion of the vapor leaving the evaporator means and the combination of the pressurized vapor leaving the first compression means and the vapor refrigerant from the condensing means are received by the second compression means individually and pressurized by the second compression means and subsequently condensed by the condensing means.

19. The system of claim 15, wherein a portion of the vapor leaving the evaporator means and the vapor refrigerant from the condensing means are received and pressurized by the second compression means, and the pressurized vapor leaving the first and second compression means are subsequently condensed by the condensing means.

20. The system of claim 15, wherein a portion of the vapor leaving the evaporator means and the pressurized vapor leaving the first compression means are received and pressurized by the second compression means, and the pressurized vapor leaving the second compression means is subsequently condensed by the condensing means.

21. The system of claim 15, wherein a portion of the vapor leaving the evaporator means is received and pressurized by the second compression means, and the pressurized vapor leaving the first and second compression means are subsequently condensed by the condensing means.

22. The system of claim 15, wherein the first compression means is activated and the second compression means is deactivated, whereby the refrigerant vapor leaving the evaporator means is received by the first compression means and subsequently received and condensed by the condensing means.

23. The system of claim 15, wherein the first compression means is deactivated and the second compression means is activated, whereby the refrigerant vapor leaving the evaporator means and the vapor refrigerant from the condensing means are received and pressurized by the second compression means and subsequently received and condensed by the condensing means.

24. The system of claim 15, wherein the first compression means is deactivated and the second compression means is activated, whereby the refrigerant vapor leaving the evaporator means is received and pressurized by the second compression means and subsequently received and condensed by the condensing means.

25. The system of claim 15, wherein the fluid communication between the first compression means and the condensing means is manipulated by a first valve and the fluid communication between the first and second compression means is manipulated by a second valve.

26. The system of claim 15, wherein each of the first and second serially-connected compressors includes at least one of reciprocating compressor, rolling compressor, scroll compressor, screw compressor, and centrifugal compressor.

27. The system of claim 15, wherein the first compression means further includes:

an absorber that forms a mixture of a refrigerant and an absorbent; and a generator that receives the mixture from the absorber and heats the mixture to separate refrigerant, in vapor form, from the absorbent.

28. The system of claim 27, wherein the pressure of the refrigerant vapor from the generator is increased by the second compression means.

29. A hybrid heat pump system comprising:

first compression means operable to form a refrigerant in vapor form and increases the pressure of the refrigerant vapor;

condensing means arranged to receive the pressurized vapor and condense the vapor under pressure to a liquid;

pressure reduction means through which the liquid refrigerant leaving the condensing means passes to reduce the pressure of the liquid to form a mixture of liquid and vapor refrigerant;

evaporator means arranged to receive the mixture of liquid and vapor refrigerant that passes through the pressure reduction means to evaporate the remaining liquid to form first and second portions of refrigerant vapor;

second compression means including a dual-cylinder compressor, a first inlet port, a second inlet port and an outlet port, the second compression means being operable to:

receive, through the first inlet port or the second inlet port and by each cylinder of the dual-cylinder compressor, at least a portion of the refrigerant vapor from the evaporator means, and the combination of the pressurized vapor from the first compression means and the vapor refrigerant from the condensing means;

increase the pressure thereof in each cylinder of the dual-cylinder compressor; and pass the pressurized vapor from each cylinder of the dual-cylinder compressor to the condensing means through the outlet port; and a conduit operable to pass a portion of the refrigerant vapor leaving the first compression means to the second compression means.

30. The system of claim 29, wherein the dual-cylinder compressor further includes an injection-type compressor for injecting the combination of the pressurized vapor from the first compression means and the vapor refrigerant from the condensing means to the dual-cylinder compressor.

31. The system of claim 29, wherein the pressure at the outlet port is higher than that at the first and second inlet ports, and the pressure at the second inlet port is higher than that at the first inlet port.

32. The system of claim 29, wherein a portion of the vapor leaving the evaporator means and the combination of the pressurized vapor leaving the first compression means and the vapor refrigerant from the condensing means are received by the second compression means individually and pressurized by the second compression means and subsequently condensed by the condensing means.

33. The system of claim 29, wherein a portion of the vapor leaving the evaporator means and the vapor refrigerant from the condensing means are received and pressurized by the second compression means, and the pressurized vapor leaving the first and second compression means are subsequently condensed by the condensing means.

34. The system of claim 29, wherein a portion of the vapor leaving the evaporator means and the pressurized vapor leaving the first compression means are received and pressurized by the second compression means, and the pressurized vapor leaving the second compression means is subsequently condensed by the condensing means.

35. The system of claim 29, wherein a portion of the vapor leaving the evaporator means is received and pressurized by the second compression means, and the pressurized vapor leaving the first and second compression means are subsequently condensed by the condensing means.

36. The system of claim 29, wherein the first compression means is activated and the second compression means is deactivated, whereby the refrigerant vapor leaving the evaporator means is received by the first compression means and subsequently received and condensed by the condensing means.

37. The system of claim 29, wherein the first compression means is deactivated and the second compression means is activated, whereby the refrigerant vapor leaving the evaporator means and the vapor refrigerant from the condensing means are received and pressurized by the second compression means and subsequently received and condensed by the condensing means.

38. The system of claim 29, wherein the first compression means is deactivated and the second compression means is activated, whereby the refrigerant vapor leaving the evaporator means is received and pressurized by the second compression means and subsequently received and condensed by the condensing means.

39. The system of claim 29, wherein the fluid communication between the first compression means and the condensing means is manipulated by a first valve and the fluid communication between the first and second compression means is manipulated by a second valve.

40. The system of claim 29, wherein the dual-cylinder compressor includes at least one of reciprocating compressor, rolling compressor, scroll compressor, screw compressor, and centrifugal compressor.

41. The system of claim 29, wherein the first compression means further includes:

an absorber that forms a mixture of a refrigerant and an absorbent; and a generator that receives the mixture from the absorber and heats the mixture to separate refrigerant, in vapor form, from the absorbent.

42. The system of claim 41, wherein the pressure of the refrigerant vapor from the generator is increased by the second compression means.

43. A hybrid heat pump system comprising:

first compression means operable to form a refrigerant in vapor form and increases the pressure of the refrigerant vapor;

condensing means arranged to receive the pressurized vapor and condense the vapor under pressure to a liquid;

pressure reduction means through which the liquid refrigerant leaving the condensing means passes to reduce the pressure of the liquid to form a mixture of liquid and vapor refrigerant;

evaporator means arranged to receive the mixture of liquid and vapor refrigerant that passes through the pressure reduction means to evaporate the remaining liquid to form first and second portions of refrigerant vapor;

second compression means including first and second parallelly-connected compressors, a first inlet port, a second inlet port and an outlet port, the second compression means being operable to:

receive, through the first inlet port or the second inlet port and by each of the first and second parallelly-connected compressors, at least a portion of the refrigerant vapor from the evaporator means, and the combination of the pressurized vapor from the first compression means and the vapor refrigerant from the condensing means;

increase the pressure thereof in each of the first and second parallelly-connected compressors; and pass the pressurized vapor from each of the first and second parallelly-connected compressors to the condensing means through the outlet port; and a conduit operable to pass a portion of the refrigerant vapor leaving the first compression means to the second compression means.

44. The system of claim 43, wherein the first and second parallelly-connected compressors further include an injection-type compressor for injecting the combination of the pressurized vapor from the first compression means and the vapor refrigerant from the condensing means to the first and second parallelly-connected compressors.

45. The system of claim 43, wherein the pressure at the outlet port is higher than that at the first and second inlet ports, and the pressure at the second inlet port is higher than that at the first inlet port.

46. The system of claim 43, wherein a portion of the vapor leaving the evaporator means and the combination of the pressurized vapor leaving the first compression means and the vapor refrigerant from the condensing means are received by the second compression means individually and pressurized by the second compression means and subsequently condensed by the condensing means.

47. The system of claim 43, wherein a portion of the vapor leaving the evaporator means and the vapor refrigerant from the condensing means are received and pressurized by the second compression means, and the pressurized vapor leaving the first and second compression means are subsequently condensed by the condensing means.

48. The system of claim 43, wherein a portion of the vapor leaving the evaporator means and the pressurized vapor leaving the first compression means are received and pressurized by the second compression means, and the pressurized vapor leaving the second compression means is subsequently condensed by the condensing means.

49. The system of claim 43, wherein a portion of the vapor leaving the evaporator means is received and pressurized by the second compression means, and the pressurized vapor leaving the first and second compression means are subsequently condensed by the condensing means.

50. The system of claim 43, wherein the first compression means is activated and the second compression means is deactivated, whereby the refrigerant vapor leaving the evaporator means is received by the first compression means and subsequently received and condensed by the condensing means.

51. The system of claim 43, wherein the first compression means is deactivated and the second compression means is activated, whereby the refrigerant vapor leaving the evaporator means and the vapor refrigerant from the condensing means are received and pressurized by the second compression means and subsequently received and condensed by the condensing means.

52. The system of claim 43, wherein the first compression means is deactivated and the second compression means is activated, whereby the refrigerant vapor leaving the evaporator means is received and pressurized by the second compression means and subsequently received and condensed by the condensing means.

53. The system of claim 43, wherein the fluid communication between the first compression means and the condensing means is manipulated by a first valve and the fluid communication between the first and second compression means is manipulated by a second valve.

54. The system of claim 43, wherein each of the first and second parallelly-connected compressors includes at least one of reciprocating compressor, rolling compressor, scroll compressor, screw compressor, and centrifugal compressor.

55. The system of claim 43, wherein the first compression means further includes:

an absorber that forms a mixture of a refrigerant and an absorbent; and a generator that receives the mixture from the absorber and heats the mixture to separate refrigerant, in vapor form, from the absorbent.

56. The system of claim 55, wherein the pressure of the refrigerant vapor from the generator is increased by the second compression means.

* * * * *